United States Patent [19]

Richards

[11] Patent Number: 5,020,808

[45] Date of Patent: Jun. 4, 1991

[54] TOSSING RING

[76] Inventor: Marvin D. Richards, 418 Del Sol, Pleasanton, Calif. 94566

[21] Appl. No.: 463,453

[22] Filed: Jan. 11, 1990

[51] Int. Cl.[5] ..... A63B 65/10

[52] U.S. Cl. ..... 273/425; 446/48

[58] Field of Search ..... 273/424, 425, 426, 427, 273/428, 336; 446/46, 48

[56] References Cited

U.S. PATENT DOCUMENTS

| | | | |
|---|---|---|---|
| 281,773 | 7/1883 | Mann | 273/425 |
| 2,634,982 | 4/1953 | Gaede | 273/424 |
| 2,640,699 | 6/1953 | Garbo | 273/424 |
| 3,594,945 | 7/1971 | Turney | 273/425 X |
| 3,961,792 | 6/1976 | Shankel | 273/424 |
| 4,182,073 | 1/1980 | Tabet | 273/424 X |
| 4,288,942 | 9/1981 | Nicholl | 273/424 X |
| 4,351,129 | 9/1982 | Kerkenbush | 446/46 |
| 4,356,660 | 11/1982 | O'Brien | 446/46 X |
| 4,461,485 | 7/1984 | Horvath | 273/425 |
| 4,723,322 | 2/1988 | Shelby | 2/16 X |
| 4,752,267 | 6/1988 | Layman | 446/46 |
| 4,854,907 | 8/1989 | Holmes | 273/425 X |
| 4,889,347 | 12/1989 | Mineart | 273/424 |

*Primary Examiner*—Edward M. Coven
*Assistant Examiner*—William E. Stoll
*Attorney, Agent, or Firm*—Bielen, Peterson & Lampe

[57] ABSTRACT

A tossing ring utilizing a pair of annular bodies each including first and second transverse surfaces and outer end surfaces. First and second annular bodies are superimposed on one another such that the end surface of one of the annular bodies extends further outwardly from the openings of the annular bodies. The first annular body is fixed to the second annular body.

9 Claims, 3 Drawing Sheets

TOSSING RING

BACKGROUND OF THE INVENTION

The present invention relates to a novel tossing ring which is useful in playing games.

Tossing rings have been used to play many games or sports such as quiots. Such rings may be used to play catch, and simulate the well known games of football, baseball, golf, and the like.

U.S. Pat. No. 3,802,704 describes soft foam rings which are employed in the heretofore mentioned game of quiots. It is important, where accuracy counts, to provide a tossing ring which is aerodynamically stable. U.S. Pat. No. 4,820,230 illustrated a tossing ring which is ideal for encirclement of objects such as a pole or stake. Although the tossing ring described in the '230 patent successfully achieves its purposes, the structure of such ring requires the fairly precise cutting or sculpting of an angular cross-sectional configuration. In addition, the range of the '230 tossing ring is generally restricted by the density of the foam material employed.

A tossing ring constructed of foam materials of various densities, which exhibits aerodynamic stability and may be easily constructed to achieve flight over a range of distances, would be a notable advance in the field of toys and games.

SUMMARY OF THE INVENTION

In accordance with the present invention a novel and useful tossing ring is provided.

A tossing ring of the present invention utilizes a first annular body having a first transverse surface relative to the opening in the annular body. A second transverse surface is also included and terminates in an outer end surface. A second annular body is also provided in the present invention having first and second transverse surfaces and an outer end surface. The outer end surface of the second annular body extends further transversely than the outer surface of the first annular body. In other words, the second annular body may have an overall diameter which is larger. The openings of the first and second annular bodies are superimposed on one another and means is included for adherence of the second transverse surface of the first annular body to the first transverse surface of the second annular body.

The first and second outer surfaces of the first and second annular bodies may be generally perpendicular to the transverse surfaces of the first and second annular bodies. In addition, such end surfaces may be rounded, knife-edged, angular or the like.

A third annular body may also be employed in the present invention being sandwiched between the first and second annular bodies. The third annular body may be composed of a different material than first and second annular bodies. For example, the first and second annular bodies may be formed of soft foam-like material while the third annular body could be a hard non porous material such as wood, metal, or non-foam plastic.

The adhering means may take the form of a mastic or glue which is placed between the first and second annular bodies in one case. Where a third annular body is employed, the fastening means may take the form of a mastic or glue place on the transverse surfaces of the third annular body. The end surfaces of the first second or third annular bodies may be offset from one another i.e. extending different distances outwardly from the openings of the annular bodies. In addition, the end surfaces of the annular bodies may take a concave, convex, or rectangular shape. In addition, an appendage may be employed with the first annular body to extend to the under surface of the second annular body and provide a convenient gripping area or cavity for the tossing ring.

Moreover, a cover may be employed to overlap or enclose the opening of the first, second, or third annular bodies.

It may be apparent that novel and useful tossing ring has been described.

It is therefore an object of the present invention to provide a tossing ring which is easily constructed and exhibits aerodynamically stable flight.

It is another object of the present invention to provide a tossing ring which may be constructed of soft foam-like material but is capable of being altered to permit scaling of the tossing ring over a variety of distances.

It is yet another object of the present invention to provide a tossing ring which is composed of a plurality of annular bodies and exhibits great aesthetic appeal to the user thereof.

A further object of the present is to provide a tossing ring which may be constructed of light weight or heavy weight foam plastic material and exhibits consistent aerodynamic capability.

The invention possesses other objects and advantages especially as concerns particular characteristics and features thereof which will become apparent as the specification continues.

BRIEF DESCRIPTION OF THE DRAWINGS

FIG. is a bottom, front perspective view of an embodiment of the present invention.

For a better understand of the invention reference is made to the following detailed description of the preferred embodiments thereof which should be reference to the hereinabove described drawings.

DESCRIPTION OF THE PREFERRED EMBODIMENTS

Various aspects will evolve from the following detailed description of the preferred embodiments which should be compared to the prior delineated drawings.

Figure 1:
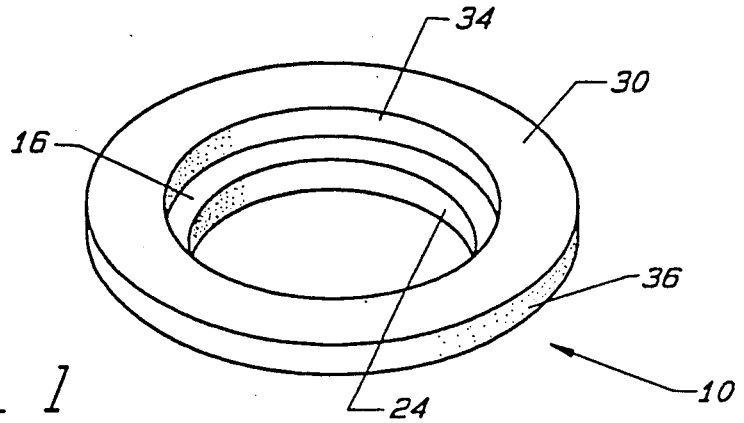
Figure 2:
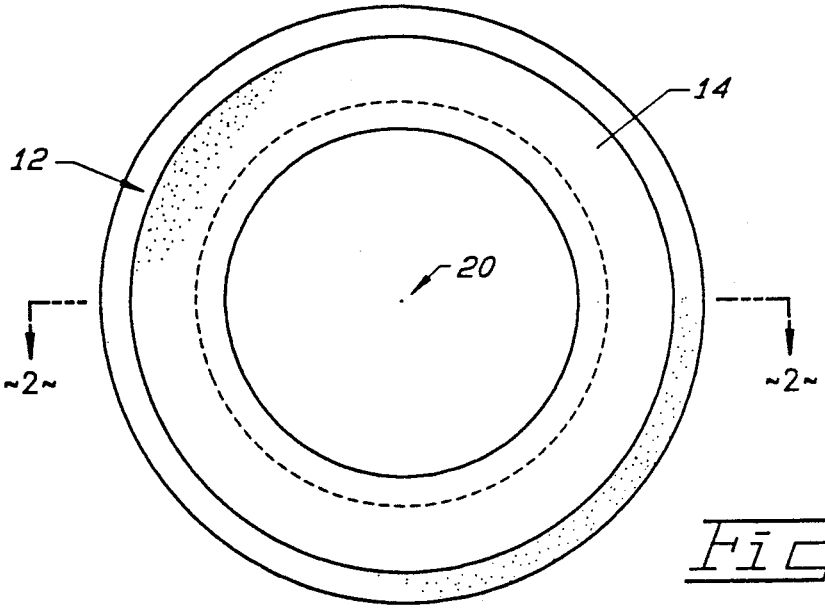
FIG. 2 is a top plan view of the embodiment depicted in FIG. 1.

The invention as a whole is shown in the drawings by reference character 10. Tossing ring 10 includes as one of its elements a first annular body 12 which possesses a first transverse surface 14. Opposite first transverse surfaces 14 of first annular body 12 is a second transverse surface 16, FIGS. 1–3. Annular opening 18 lies substantially along central access 20. Outer end surface 22 and inner end surface 24 connect transverse surfaces 14 and 16 of annular body 12.

Tossing ring 10 also includes a second annular body 26 which is slightly larger in diameter than first annular body 12. Second annular body includes a first transverse surface 28 and a second transverse surface 30 relative to axis 20. Inner end surface 34 and outer end surface 36 connect transverse surfaces 28 and 30 of second annular body 26, in similar manner to annular body 12. First and second annular bodies 12 and 26 are constructed of soft foam plastic material such as polyurethane, polyethylene, and the like. Such material generally has a density of one to two pounds per cubic foot.

Figure 3:
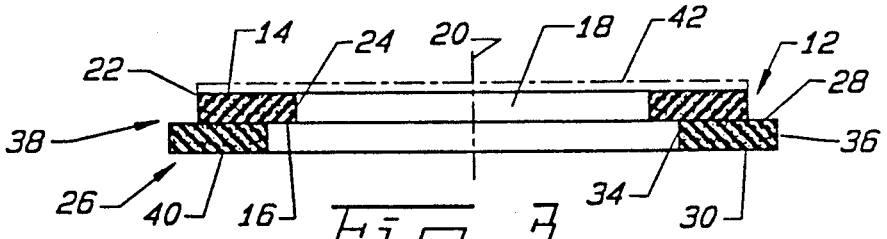
FIG. 3 is a sectional view taken along line 2—2 of FIG. 3 and showing an optional cover in phantom.

Means 38 is also included in the present invention for adhering first annular body 12 to second annular body 26. Means 38 may take the form of glue, mastic, sonic welding, fasteners, or any suitable item which would hold first annular member 12 to second annular member 26 such that the openings of both annular members lie generally along axis 20. In such a configuration, FIG. 3, second annular member 26 extends beyond the periphery of first annular member 12. In FIG. 3, means 38 is depicted as a thin layer of glue 40 illustrated as a thick solid line between annular bodies 12 and 26. It should be observed, that annular body 12 may have a different color than annular body 26. Relative configuration of outer end surfaces 22 and 36 as well as inner end surfaces 24 and 34, permit an aerodynamically level flight of tossing ring 10. A cover 42 may also be employed to enclose annular opening 18 of first annular body 12 along first transverse surface 14.

Figure 6:
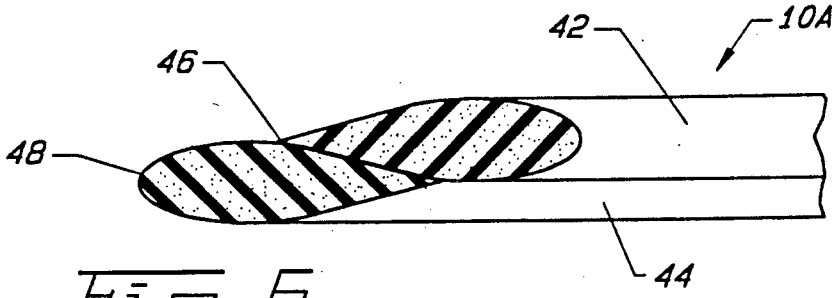
FIG. 6 is a sectional view depicting a variation of the embodiment shown in FIG. 3, with rounded outer end surfaces for the annular bodies.
Figure 7:
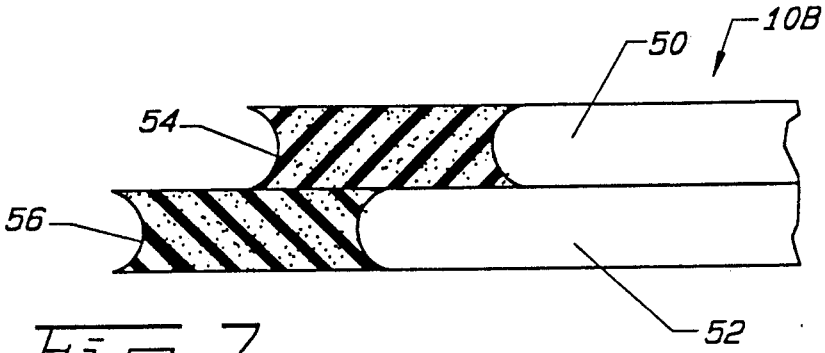
FIG. 7 is a sectional view showing the variation of the embodiment depicted in FIG. 3 with the outer end surfaces of the annular bodies being concave.

Turning to FIGS. 6 and 7, it may be seen that tossing rings 10A and 10B are illustrated. Tossing ring 10A includes annular members 42 and 44 and include outer end surfaces 46 and 48 which are in the shape of a sharp knife-like edge or a convex edge, respectively. Tossing ring 10B includes annular members 50 and 52 which have convex outer end surfaces 54 and 56.

Figure 8:
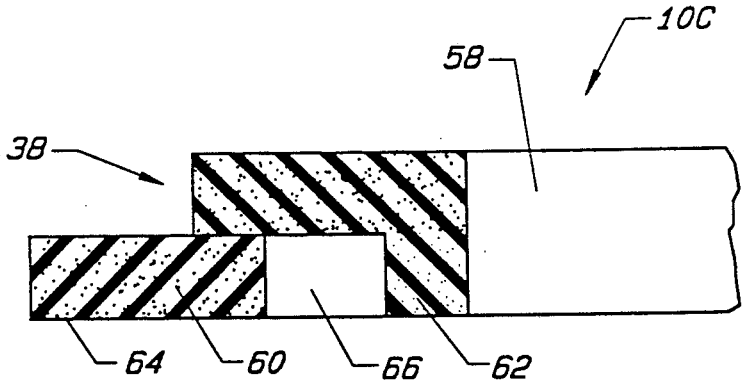
FIG. 8 is a sectional view of yet another embodiment of the present invention.

FIG. 8 depicts another embodiment 10C of the tossing ring of the present invention in which annular members 58 and 60 are fastened together by means 38. In addition, annular member 58 includes appendage 62 which extends downwardly toward the bottom surface 64 of annular member 60. Appendage 62 and the remainder of annular members 58 and 60 form a cavity 66 which aids in the aerodynamically stability of the tossing ring 10C as well as providing a convenient hand hold for tossing ring 10C.

Figure 9:
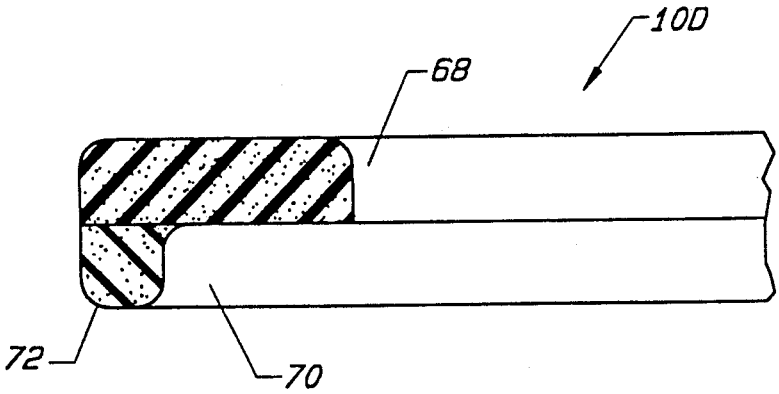
FIG. 9 is a sectional view showing a further embodiment of the present invention.

FIG. 9 shows another embodiment 10D of the tossing ring of the present invention in which annular body 68 and annular body 70 are held together by means 38. Annular body 78 includes a rounded surface 72.

Figure 4:
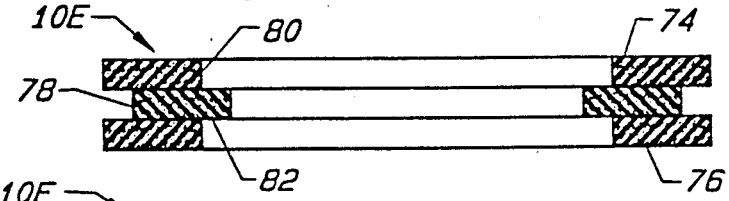
FIG. 4 is a sectional view showing another embodiment of the present invention.
Figure 5:
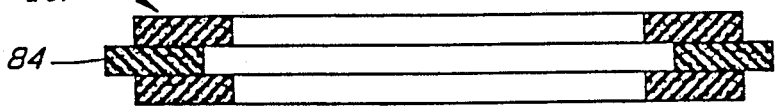
FIG. 5 is a sectional view showing still another embodiment of the present invention.
Figure 10:
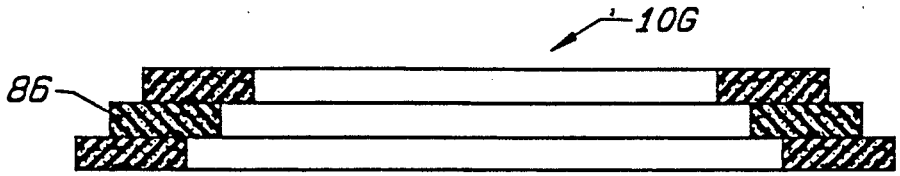
FIG. 10 is a sectional view showing a tossing ring of the present invention using three annular bodies.

Now referring to FIGS. 4, 5 and 10, it may be observed that tossing ring embodiments 10E, 10F, and 10G are depicted. Each of the embodiments shown in FIGS. 4, 5, and 10 include a third annular member sandwiched between two other annular members. For example, in embodiment 10E, FIG. 4, annular members 74 and 76 sandwich third annular member 78 therebetween. Means 38 in the form of glue or mastic layers 80 and 82 lie on the outer surface of the third annular member 78. Third annular members 84 and 86 lie between outer members of embodiments 10F and 10G, FIGS. 5 and 10. As depicted in these figures, all the annular members forming tossing rings 10E, 10F, and 10G include flattened outer end surfaces which are generally perpendicular to the outer transverse surfaces thereof.

Figure 11:
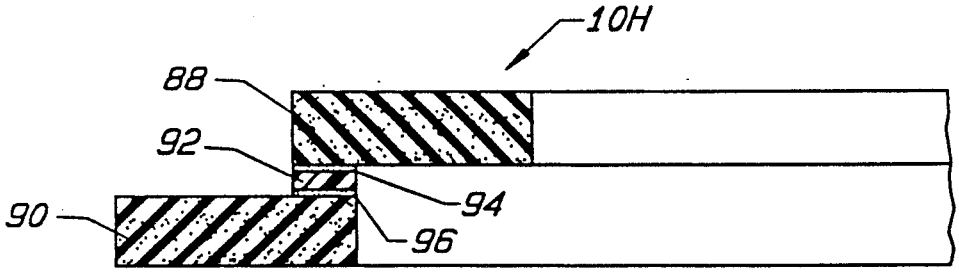
FIG. 11 is a sectional view showing a tossing ring of the present invention using three annular bodies, one of which possesses a different density.
Figure 12:
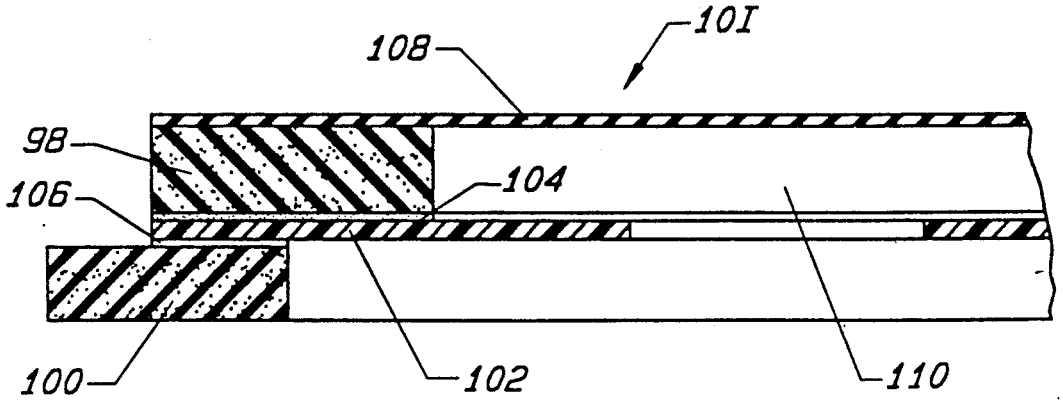
FIG. 12 is a sectional view depicting a tossing ring of the present invention utilizing three annular bodies, one of which possesses a different density and possesses the smallest annular opening of any of the annular bodies.

FIGS. 11 and 12 depict embodiments 10H and 10I respectively of the tossing ring of the present invention. Annular members 88 and 90, FIG. 11, sandwich a third annular member 92 by means 38 in the form of glue or mastic layers 94 and 96. Annular member 92 is constructed of a denser material than annular members 88 and 90, which are illustrated as being a soft foam plastic. Annular member 92 may be formed of metal, wood, or a hard non-foam plastic. The thickness of annular member 92 may be chosen to add weight to tossing ring 10H to provide flight through a greater distance than the tossing rings shown in FIGS. 1–10.

With reference to FIG. 12, tossing ring 10I includes annular members 98 and 100 which sandwich annular member 102 via glue layers 104 and 106. Annular 102 extends inwardly further than annular member 92 of tossing 10H which provides a greater rigidity to tossing ring 10I than the prior described tossing ring 10H. In addition, a cover 108 is provided to partially or fully enclose opening 110 of annular member 98.

In operation the user merely grasps any of the tossing rings shown in FIGS. 1–12 and scales the same through the air. Any of the rings depicted will be aerodynamically stable, however the tossing rings 10H and 10I of FIGS. 11 and 12 will fly a longer distance due to the weighting provided by third annular members 92 and 102, respectively thereof.

While in the foregoing embodiments of the invention have been set forth in considerable detail for the purposes of making a complete disclosure of the invention it may be apparent to those of skill in the art that numerous changes may be made in such details without departing from the spirit and principles of the invention.

What is claimed is:

1. A tossing ring, adapted to be manually thrown into the air and to be caught by grasping its peripheral edge while in flight comprising:

a. a first annular body having a first transverse surface relative to the opening of said annular body, a second transverse surface relative to said opening of said annular body and an outer end surface, said first annular body opening extending through said annular body between said first and second transverse surfaces thereof;

b. a second annular body having a first transverse surface relative to the opening of said annular body, a second transverse surface relative to said opening of said annular body, and an outer end surface, said second annular body opening extending through said annular body between said first and second transverse surfaces thereof; and c. means for adhering said second transverse surface of said first annular body to said first transverse surface of said second annular body with said openings of said first and second annular bodies being superimposed, said outer end surface of said second annular body extending further outwardly transversely from said superimposed openings of said annular bodies, the outer end surfaces of said first and second annular bodies being exposed and separated from each other in stepped configuration.

2. The tossing ring of claim 1 which further comprises said outer end surfaces of said annular bodies each including a flattened surface generally perpendicularly disposed relative to said second transverse surface of said second annular body.

3. The tossing ring of claim 1 which further comprises another annular body having a first transverse surface and a second transverse surface, said first transverse surface of said another annular body lying adjacent said second transverse surface of said second annular body, and said adhering means additionally comprises fastening means on said first surface of said another annular body and said second surface of said second annular body.

4. The tossing ring of claim 3 in which said another annular body includes an outer end surface extending further transversely relative to said superimposed openings than said outer surfaces of said second annular body.

5. The tossing ring of claim 1 in which said end surface of said first annular body is concave relative to said opening of said first annular body.

6. The tossing ring of claim 1 in which said end surface of said second annular body is convex relative to said opening of said second annular body.

7. The tossing ring of claim 1 in which said second transverse surface of said second annular body is rounded.

8. The tossing ring of claim 1 which further comprises an appendage extending from said second surface of said first annular body and lying adjacent to said second surface of said second annular body.

9. The tossing ring of claim 1 which additionally comprises a cover connected to said first transverse surface of said first annular body, said cover overlapping said opening of said first annular member.

* * * * *